US010492591B2

(12) United States Patent
Girod

(10) Patent No.: US 10,492,591 B2
(45) Date of Patent: Dec. 3, 2019

(54) HAIRCARE ITEM DRYING PLATFORM

(71) Applicant: Alina Girod, Sun Valley, CA (US)

(72) Inventor: Alina Girod, Sun Valley, CA (US)

( * ) Notice: Subject to any disclaimer, the term of this patent is extended or adjusted under 35 U.S.C. 154(b) by 121 days.

(21) Appl. No.: 15/793,213

(22) Filed: Oct. 25, 2017

(65) Prior Publication Data

US 2018/0132597 A1 May 17, 2018

Related U.S. Application Data

(60) Provisional application No. 62/412,660, filed on Oct. 25, 2016.

(51) Int. Cl.

| | |
|---|---|
| ***A45D 20/44*** | (2006.01) |
| ***A45D 4/18*** | (2006.01) |
| ***A45D 44/04*** | (2006.01) |
| ***A45D 20/42*** | (2006.01) |
| ***F26B 9/06*** | (2006.01) |
| ***A47G 29/08*** | (2006.01) |
| *A45D 20/10* | (2006.01) |

(52) U.S. Cl.

CPC ..... *A45D 44/04* (2013.01); *A45D 20/42* (2013.01); *A47G 29/08* (2013.01); *F26B 9/066* (2013.01); *A45D 20/10* (2013.01)

(58) Field of Classification Search

CPC ..... A45D 20/00; A45D 20/16; A45D 20/44; A45D 4/18; A45D 19/0016; A45D 8/00

See application file for complete search history.

(56) References Cited

U.S. PATENT DOCUMENTS

| | | | | |
|---|---|---|---|---|
| 3,320,681 | A * | 5/1967 | Watlington | A45D 20/42 211/33 |
| 4,162,580 | A * | 7/1979 | Hess | A45D 44/02 248/231.71 |
| 4,712,313 | A | 12/1987 | Gettleman | |
| 4,814,219 | A | 3/1989 | Binger | |
| 4,848,007 | A * | 7/1989 | Montagnino | A45D 20/122 34/97 |
| 5,060,398 | A | 10/1991 | Wolens | |
| 5,592,749 | A | 1/1997 | Trimmer | |
| 5,613,305 | A | 3/1997 | Martin | |
| 6,520,467 | B2 | 2/2003 | Thomas | |
| 7,562,661 | B2 | 7/2009 | Ueyama et al. | |
| 8,720,703 | B1 * | 5/2014 | Pressler | A46B 17/02 211/1.3 |
| 10,234,196 | B2 * | 3/2019 | McCloud | F26B 9/06 |
| 2017/0119145 | A1 * | 5/2017 | Munoz | A46B 17/065 |
| 2017/0254588 | A1 * | 9/2017 | McCloud | F26B 9/06 |
| 2018/0296008 | A1 * | 10/2018 | Cho | A47F 7/065 |

* cited by examiner

*Primary Examiner* — Gregory A Wilson

(57) ABSTRACT

A haircare item drying platform (HIDP) that functions as a free standing device or in combination with an over-head blow dryer to dry haircare items such as brushes, combs or human hair. The HIDP includes a disk with a center section that is either a solid uniform material or is made of a mesh material. A haircare item is placed on the center section or is inserted through and maintained within an opening on the center section. The HIDP with haircare items thereon is placed on a surface and elevated by at least three removably attached legs, or attachment means are utilized for securing the HIDP to the head opening on the over-head blow dryer. The haircare items can then air dry from ambient air, can have heated air applied from a hand-held blow dryer, or are dried from heated air applied onto the HIDP from the over-head blow dryer.

17 Claims, 15 Drawing Sheets

HAIRCARE ITEM DRYING PLATFORM

TECHNICAL FIELD

The invention generally pertains to items for haircare, and more particularly to a haircare items drying platform that when used in combination with a standard over-head blow dryer provides a means of quickly and easily drying recently washed items such as brushes, combs or human hair.

BACKGROUND ART

Haircare professionals use a variety of products and items when performing hair services. Hair products typically refer to shampoo, color and lightening chemicals. Haircare items include scissors, brushes, combs and other items that are used to cut and style hair, and to apply color or lightener.

During the course of a day, a haircare professional may perform services on multiple clients. It is not practical or economically feasible to use a new brush, comb or other item on each client. So, in order to ensure the brushes, combs and other items are clean and hygienically acceptable, and to provide an overall sanitary environment. The items must be cleaned after use on each client. The most effective and common cleaning consist of washing the item(s) with water and soap.

A problem arises when a haircare professional is busy with multiple clients, many who have been waiting for their service, and the recently-washed items must dry before being used again. The typical solution to this is to dry the items with a towel or napkin, but with item such as brushes or combs it is difficult or impossible to completely dry a brush or a comb, particularly between the bristles or teeth. Other methods are to allow the items to air-dry, which can take an extended period of time, or for the haircare professional to use heated air from a hand-held blow dryer which requires the haircare professional to hold the blow dryer in their hand until the item(s) are dry. All the time while the clients are waiting and presumably becoming irritated as a result.

What is needed is a method by which haircare items such as brushes, combs or human hair can be quickly and easily dried after being washed, and that does not require the attention/participation of a haircare professional during the drying. The best scenario would be to provide a method, or device, that would allow a single or multiple haircare items to be completely dried at one item, and dried quickly enough that there is no unreasonable waiting time posed on clients or the haircare professional. A device that could accomplish this would be extremely beneficial for both haircare professionals and clients.

A search of the prior art did not disclose any literature or patents that read directly on the claims of the instant invention. However, the following U.S. patents are considered related:

| PATENT NO. | INVENTOR | ISSUED |
|---|---|---|
| 4,814,219 | Binger | Mar. 28, 1989 |
| 4,848,007 | Montagnino | Jul. 18, 1989 |
| 7,562,661 | Ueyama, et al | Jul. 21, 2009 |
| 2017/0254588 | McCloud | Sep. 7, 2017 |

The U.S. Pat. No. 4,814,219 patent discloses an attachments for portable hair dryers for drying other than hair, and specifically to a flexible, inflatable attachment into which is placed items of apparel, which are then attached to a portable hair dryer for directing heated air through and around the apparel items to dry them in a short time.

The U.S. Pat. No. 4,848,007 patent discloses a diffuser attachment for a hair dryer. The invention includes a perforated face plate having a diameter between 2 and 6 times that of the nozzle portion of the hair dryer to which the diffuser is attached. A plurality of slot portions enable unheated air to enter the diffuser attachment during use and enables heated air to escape after use.

The U.S. Pat. No. 7,562,661 patent discloses a hair warming tool in the form of sheet that has at least one heating part in the center and a margin around the heating part. Tied hair in the heating part is held in place to keep by fastening the margin with a fastening means.

The 2017/0254588 publication discloses a device for drying hair extensions. The device includes an elongated main body having a hinged door and an interior space. A blower unit having a fan and a heat element are positioned along the top end of the main body and force air into the interior space. A hanger unit within the interior space aligns hair extensions beneath the forced air.

For background purposes and indicative of the art to which the invention relates reference may be made to the following remaining patents found in the patent search.

| PATENT NO. | INVENTOR | ISSUED |
|---|---|---|
| 4,712,313 | Gettleman | Dec. 15, 1987 |
| 5,060,398 | Wolens | Oct. 29, 1991 |
| 5,592,749 | Trimmer | Jan. 14, 1997 |
| 5,613,305 | Martin | Mar. 25, 1997 |
| 6,520,467 | Thomas | Feb. 18, 2003 |

DISCLOSURE OF THE INVENTION

A haircare item drying platform (HIDP) that functions as a stand-alone device or in combination with an over-head blow dryer to facilitate the drying of haircare items by utilizing ambient air, heated air from a hand-held blow dryer, or heated air that is produced by and emanated from the over-head blow dryer. The HIDP is comprised of a disk with an upper surface, a lower surface, a perimeter edge, and a center section that is either a solid uniform surface made of the same material as the disk or is made of a mesh material and having at least one opening. Located on the upper surface, adjacent the perimeter edge, or on the perimeter edge are at least two attachment means for securing the disk to a head opening on the over-head blow dryer. The center section has at least one opening into which a haircare item is placed, with each center section opening preferably having a plurality of outward extending slits, or the center section has at least one cut-out that is dimensioned to accept a haircare item. At least one haircare item is placed on said center section or is inserted into the opening and captively retained within the opening with a functional component of the haircare item exposed upon an upper surface of the center section. The disk is secured by attachment means onto and substantially covering the head opening on the over-head blow dryer. Once the disk with at least one haircare item thereon is secured, the overhead blow dryer is activated, thereby blowing heated air onto the disk and haircare item. After a selected period of time said disk is released from the overhead blow dryer and the haircare item is removed from the disk.

Alternately, haircare item(s) can simply be placed in the openings or laid on the disk's upper surface and either allowed to air dry from ambient air or dried from heated air applied from a device such as a hand-held blow dryer.

Additionally, the HIDP can include at least three removably attached legs that extend downward from the perimeter edge of the disk. The legs allow the HIDP to be placed in an elevated position on a flat surface, such as a table. Haircare item(s) can then be placed on the upper surface of the disk to air dry or have heated air applied.

In view of the above disclosure the primary object of the invention is to provide a haircare item drying platform that quickly and easily facilitates the drying, either by ambient air or heating air from a device, one or more haircare items such as brushes, combs or human hair.

In addition to the primary object it is also an object of the invention to provide a haircare item drying platform that:

- is easy to use,
- can be used to dry various haircare items,
- is sanitary,
- does not damage a haircare item,
- significantly reduces the time required to dry a haircare item,
- is durable and long-lasting,
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms that disclose a preferred embodiment with multiple design configurations of a haircare item drying platform (HIDP 10) also known as the Prodry Disc™. During a typical workday a haircare professional may perform hair care procedures on multiple people. One of the most used and required items haircare professional uses is a hair brush or comb. As a result of hygiene requirements and board requirements, a brush or comb (or any item) that is used on a client must be washed and disinfected prior to use on a different/subsequent client. Also, any hair care item that comes in contact with the floor or other un-hygienic surface must be washed and disinfected. After being washed, an item must dry, which can often take an extended period of time. This can be problematic if there are clients waiting for service. The HIDP 10 offers a solution to this problem by providing a quick and easy method of drying a haircare item or items.

Figure 1:
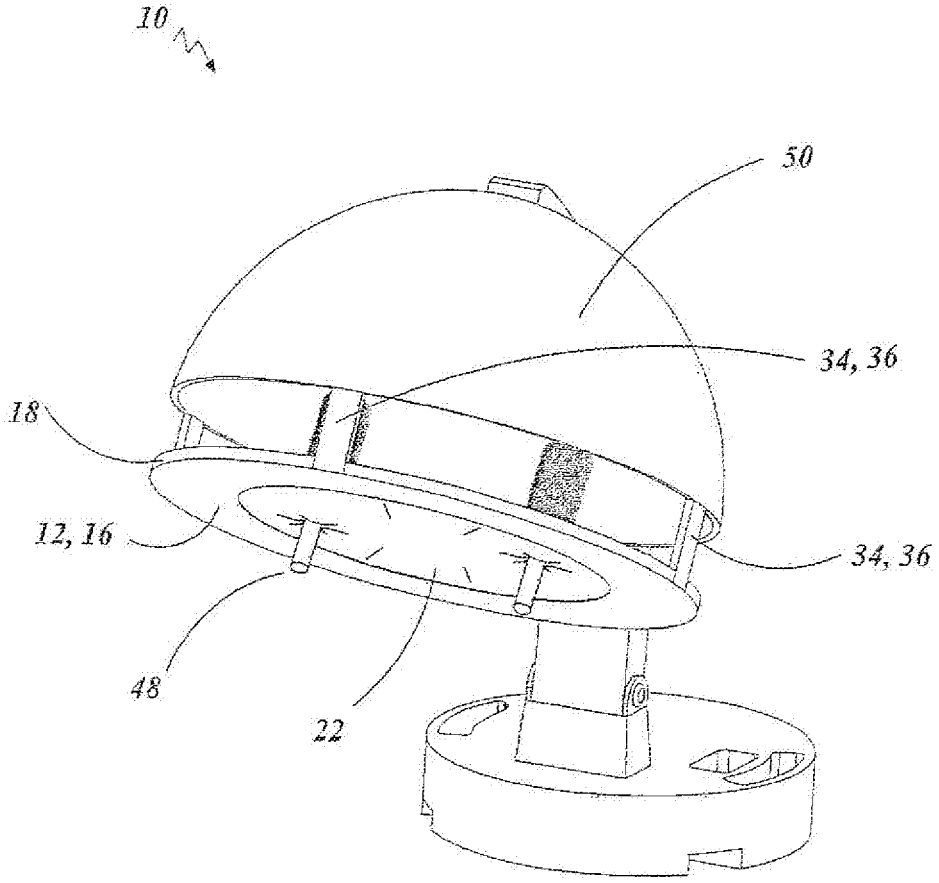
FIG. 1 is a front orthographic view of a haircare item drying platform (HIDP) beneath an over-head hair dryer, prior to being attached to the hair dryer, and having two haircare items inserted through and maintained on the HIDP for drying.

The HIDP 10, as shown in FIGS. 1-15, is designed to function in combination with a conventional, standard overhead below dryer 50. The opening from which heated air blows downward onto a person's head is standardized at 16-inches diameter. The HIDP 10 is equally dimensioned to fit over/across the opening on the blow dryer, as shown in FIG. 1.

The HIDP 10, as shown in FIGS. 1-15, is preferably comprised of a round disk 12 with an upper surface 14, a lower surface 16, and a perimeter edge 18. While a round disk 12 is preferred since it corresponds to the round opening on the blow dryer, other shapes, such as octagonal can be utilized. For the purpose of this disclosure, a round disk will be primarily described and shown. The disk 12 can be made of various materials. Optimally, a sturdy, lightweight, rigid material such as plastic is utilized, with other materials such as cardboard or a composite material also available.

Additionally, a rigid perimeter ring can circumvent the disk 12. The perimeter ring is preferably made of plastic but other rigid materials can also be utilized. The ring functions to maintain the shape and structural integrity of the disk 12, especially when multiple objects are placed through or on the disk.

Figure 2:
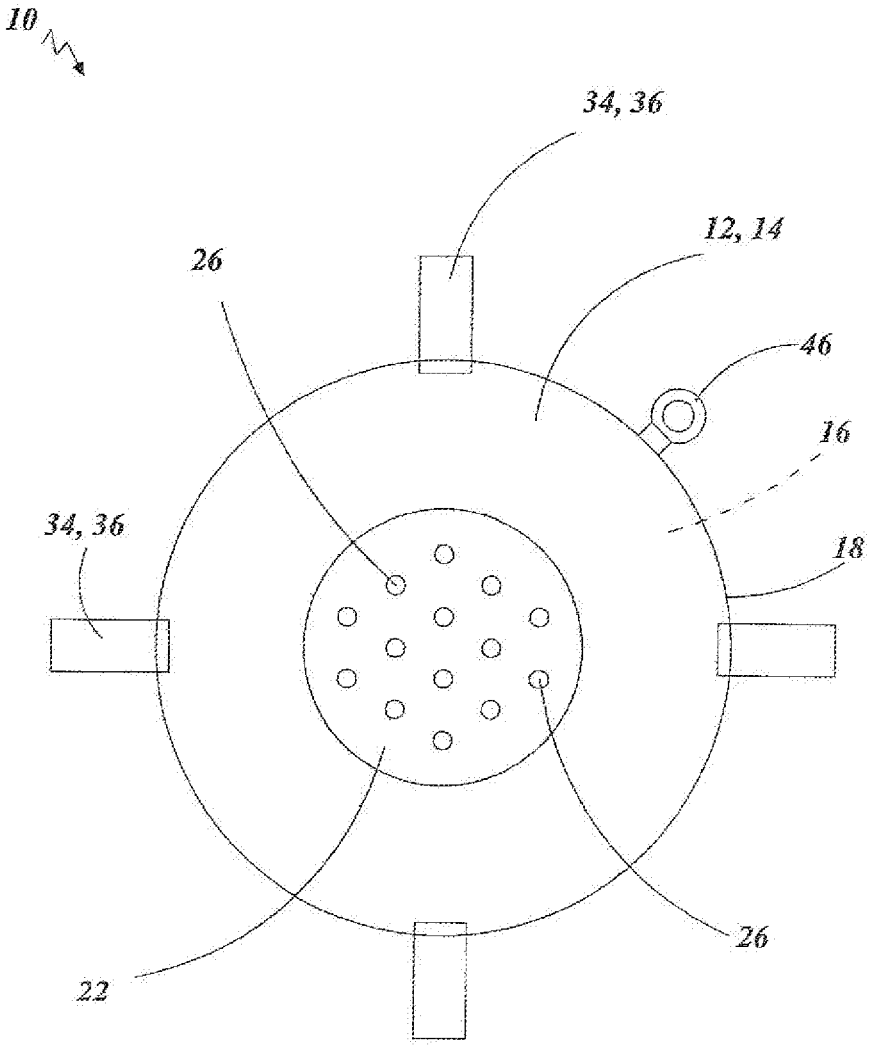
FIG. 2 is a top plan view of the HIDP having openings through a center section attachment means comprising four strips, and a ring for hanging/storing the HIDP when not in use.
Figure 3:
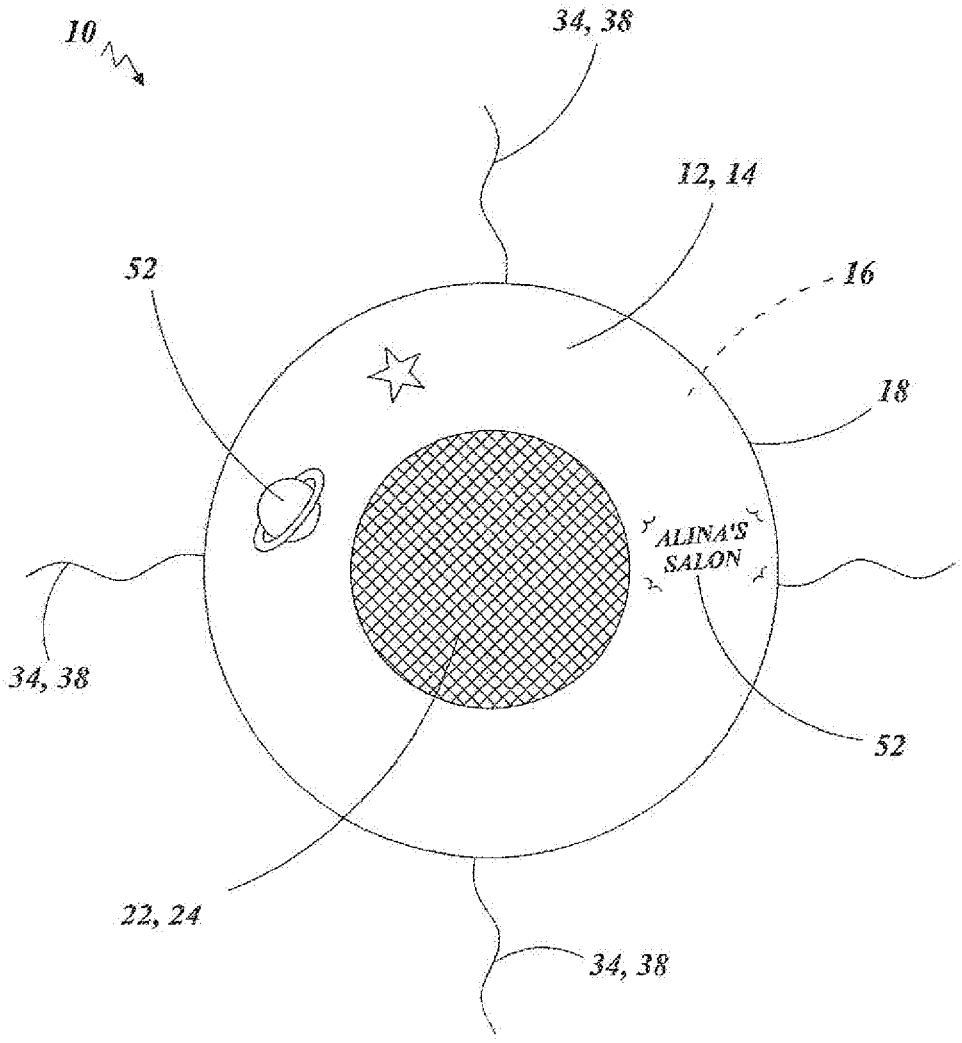
FIG. 3 is a top plan view of the HIDP having a mesh center section, attachment means comprising four lengths of string and indicia.
Figure 4:
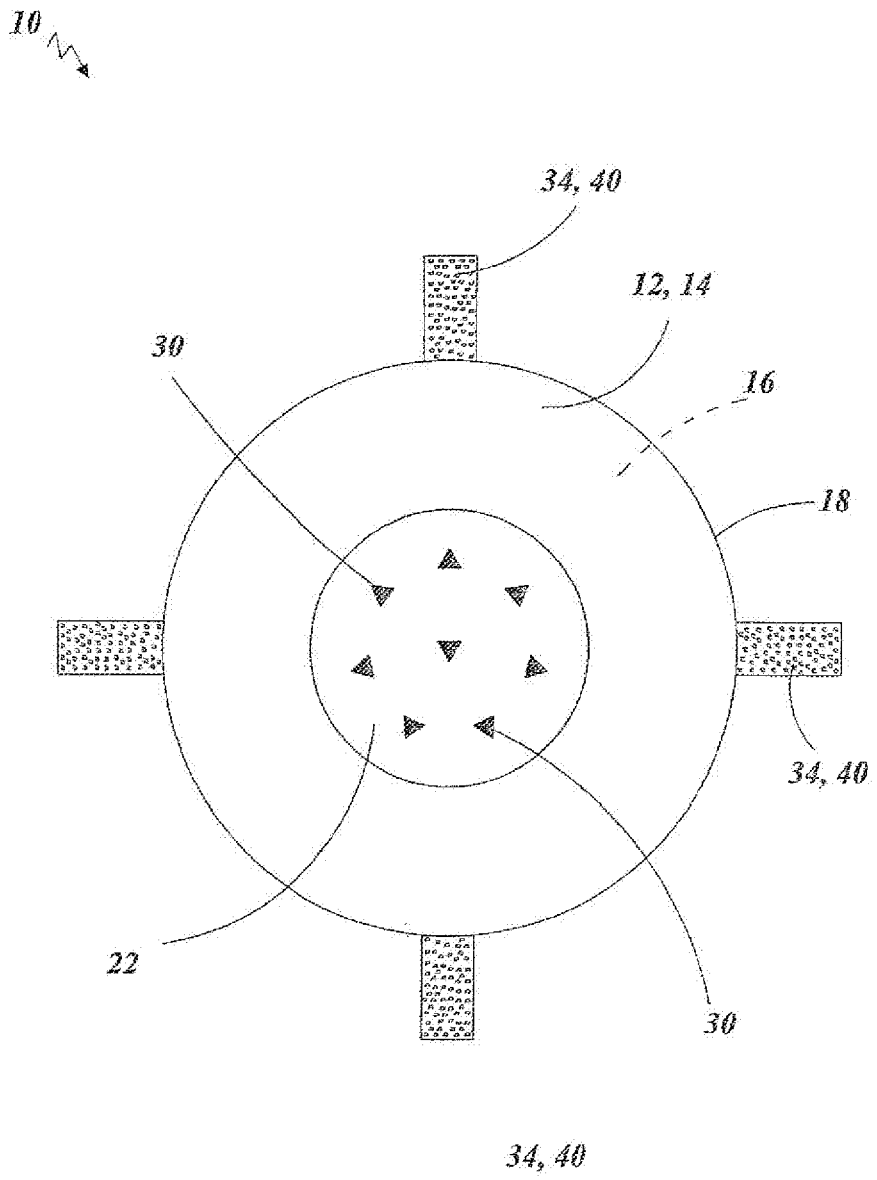
FIG. 4 is a top plan view of the HIDP having triangular cut-outs in the center section and attachment means comprising four hook and loop fasteners.

As shown in FIGS. 1-4, located on the disk 12 is a center section 22 which is preferably round, but can also be other shapes such as square, triangular, or any shape. The center section 22 can be a solid uniform section that is made of the same material as the disk, as shown in FIGS. 2 and 7-9, or the center section 22 can be made of a mesh material 24, as shown in FIGS. 3, 6 and 10-13. The mesh is especially effective for drying hair extensions, hair pieces, styling wig(s) or similar items—the drying time can be significantly reduced. Located on the center section 22 is at least one, and preferably multiple openings 26. The openings 22 function to allow the handle of a haircare item, such as a brush 48 to be inserted into/through the opening 26. A brush (or other item) is maintained in an upward position in the opening as a result of the opening 26 being sized to accept the brush's handle but not being large enough to allow the brush head to pass through. Each opening 26 can be comprised of a circular opening, as shown in FIG. 2, that is cut into the center section; triangular cut-outs 30, as shown in FIG. 4; or slits 28, as shown in FIGS. 7-9, and 15. These types of openings are merely examples of what a functionally effective opening can be comprised of. Other types, shapes or sizes can also be used with equal effectiveness. The only requirement of the opening being that the opening can accept and hold a haircare item in the proper position.

Figure 5:
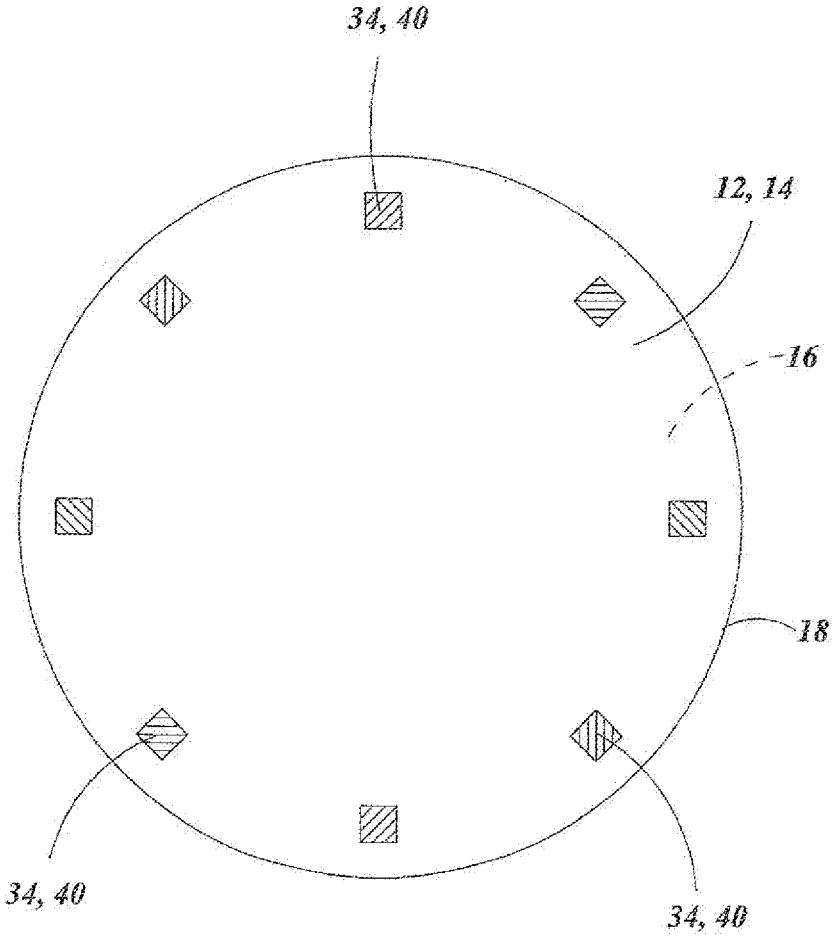
FIG. 5 is a top plan view of the HIDP without a center section and multiple tabs of hook and loop fastener.

As previously disclosed, the HIDP 10 functions in combination with a blow dryer 50. As shown in FIGS. 1-5, at least one attachment interface 34 is utilized to maintain the HIDP 10 in place beneath the opening on the blow dryer 50. The attachment interface 34 can be comprised of various attachment methods/devices including fabric (or other material) strips 36, as shown in FIGS. 1 and 2, that extend from the disk's perimeter edge 18 and are each secured onto the side of the blow dryer. Other attachment means include lengths of string 38, as shown in FIG. 3; lengths of hook and loop fastener 40, as shown in FIG. 4; tabs of hook and loop fastener 40, as shown in FIG. 5; or a snap closure (not shown). In order for most of the attachment means 34 to function, there must be a corresponding attachment device on the blow dryer 50. These devices can consist of opposing fabric strips, male or female snap closures, corresponding hook and loop fasteners, or even rings or studs to which the HIDP 10 attachment means 34 can interface with and be attached to. The corresponding attachment device(s) on the blow dryer can be permanently placed on the sides of the blow dryer, or can be non-permanently placed by use of adhesive, tape or other similar method(s).

It should be noted that the above disclosed design of the HIDP 10 is only the preferred design. Other design configurations can also be produced and utilized. For example, the most basic design of the HIDP 10 is a simple round disk having openings. There is no separate center section, rather the openings are simply selectively made in the disk and attachment means for maintaining the disk beneath the opening on a blow dryer are provided. In an even simpler design, there are no openings, as shown in FIG. 5. The HIDP 10 only comprises a disk with or without a separate center section on which haircare items are placed i.e., laid upon. The disk is then secured beneath the opening on the blow dryer.

It is important to disclose that the inventive concept is a HIDP 10 which can have haircare item(s) placed through or on, and then the disk is attached beneath the opening on a blow dryer, thereby facilitating the quick and easy drying of the recently washed haircare items by use of the heated air produced from the blow dryer. The use of the HIDP 10 along with a blow dryer can effectively dry and prepare for use a haircare item in a few minutes, which is a significantly less duration of time, and effort, experienced from previous other methods such as air-drying or towel drying.

Also, to add to the functionality and/or appearance of the HIDP 10, a ring 46, as shown in FIG. 2, can be attached to (by stitching or other means), and extends from the disk's perimeter edge 18. The ring 46 allows the HIDP 10 to be hung from a hook or similar item when the HIDP 10 is not in use. Also, indicia 52, as shown in FIG. 3, in the form of words or images can be placed on either or both surface of the disk 12. Additionally, the disk 12 can be variety of single or multiple colors.

Figure 6:
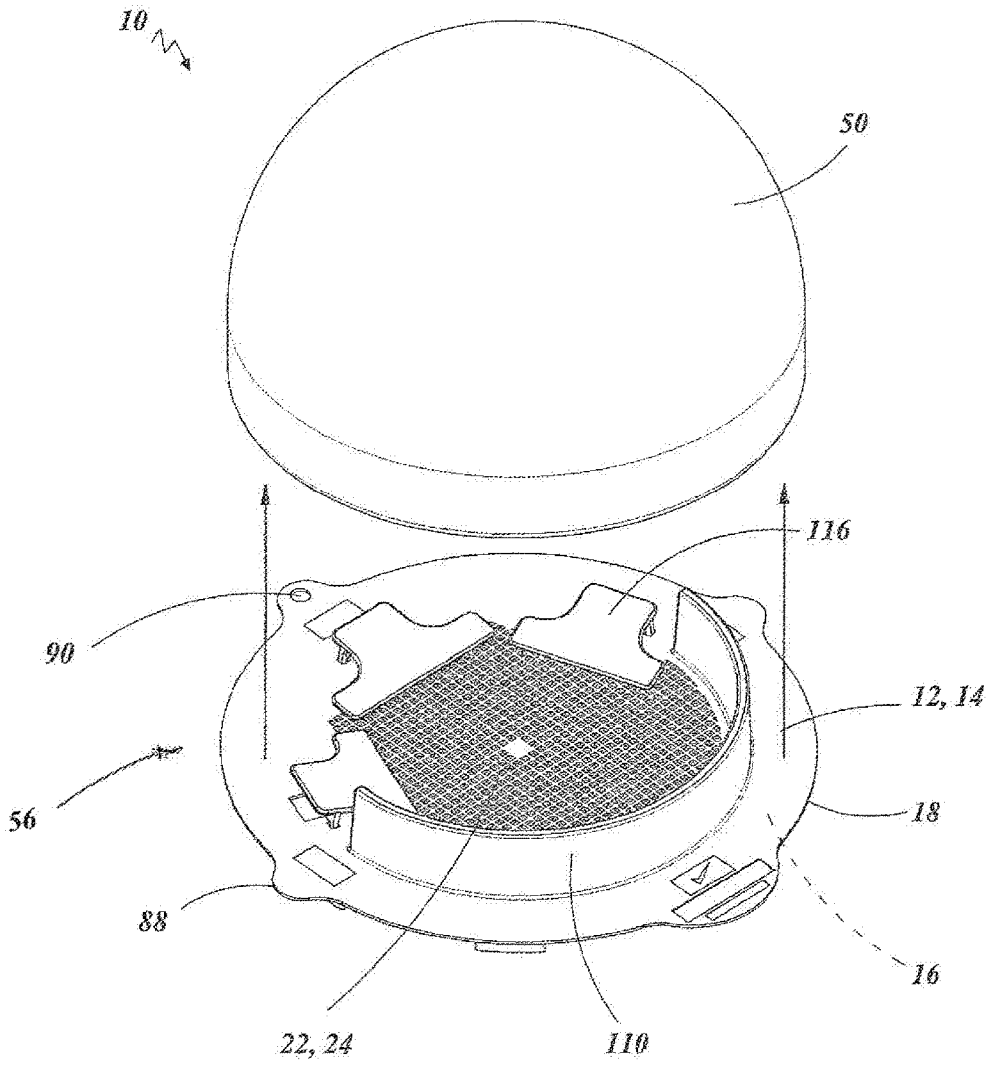
FIG. 6 is an orthographic view of a free standing HIDP beneath a hair dryer dome, prior to being attached.
Figure 7:
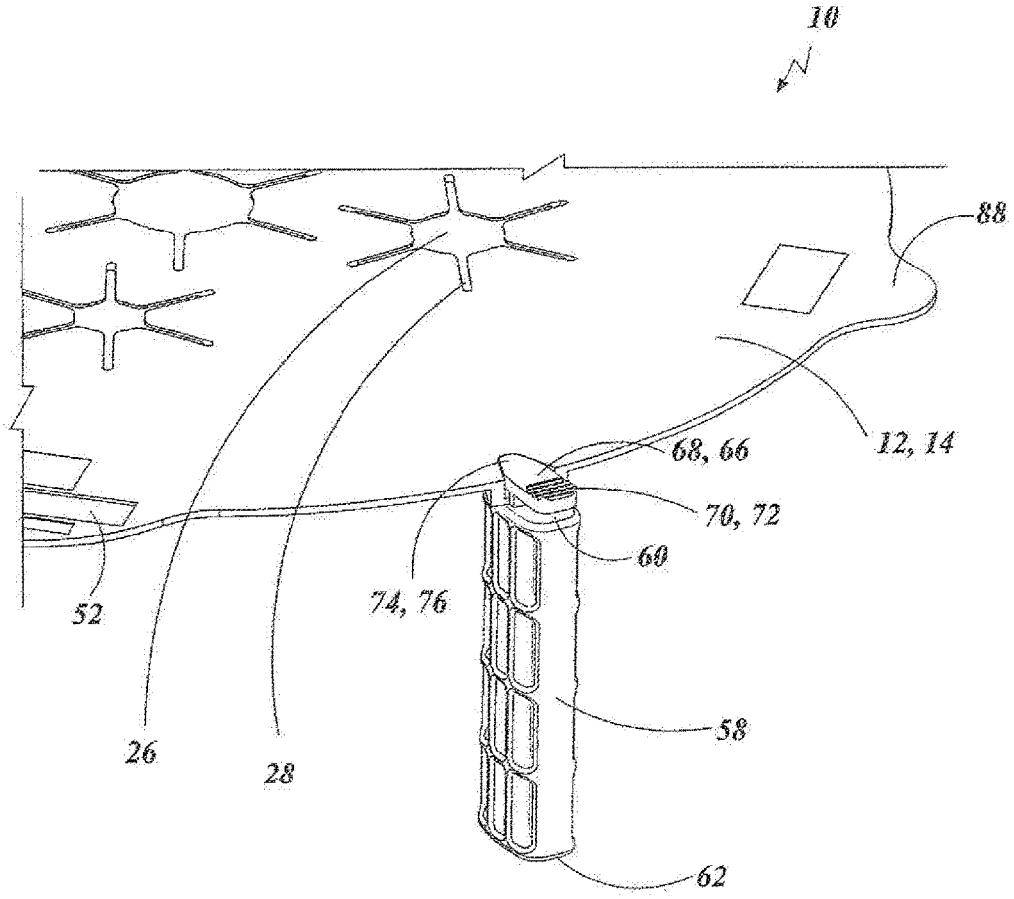
FIG. 7 is an orthographic view showing one leg attached to the HIDP disk.
Figure 8:
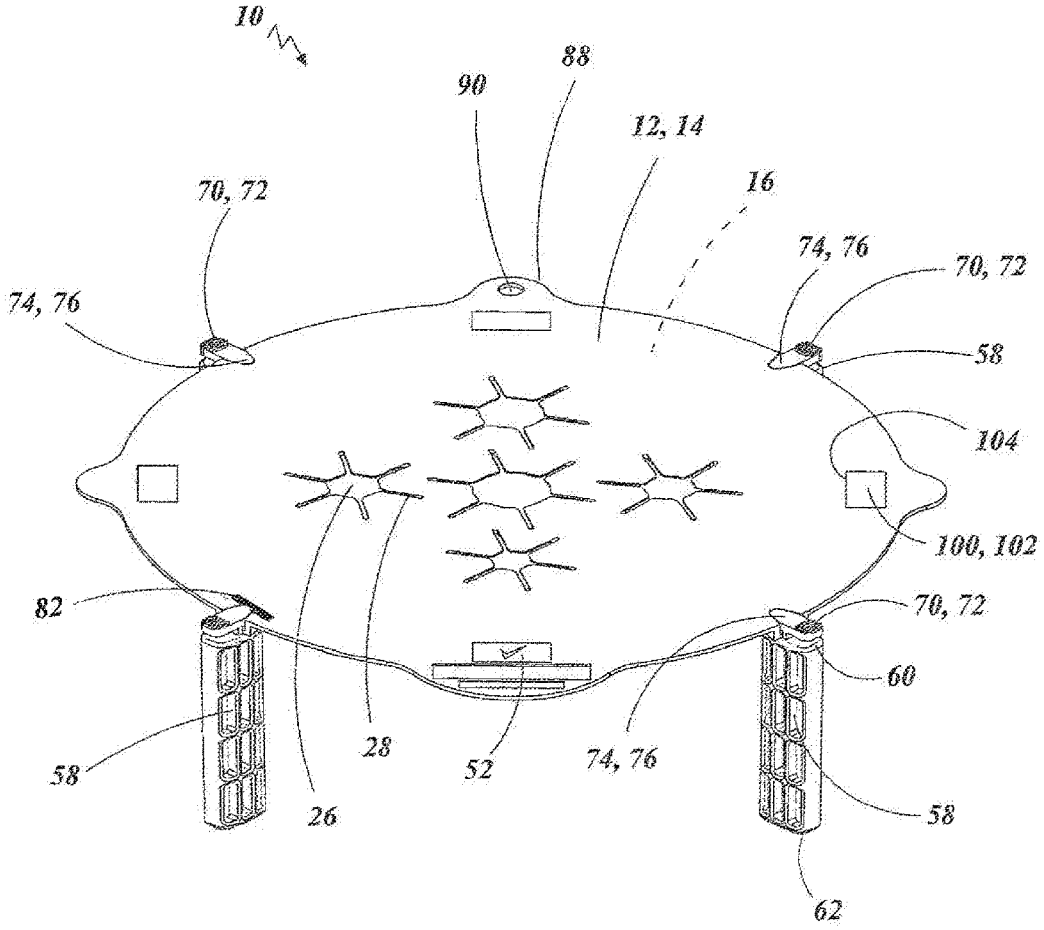
FIG. 8 is an orthographic view showing the HIDP disk with four legs attached.
Figure 9:
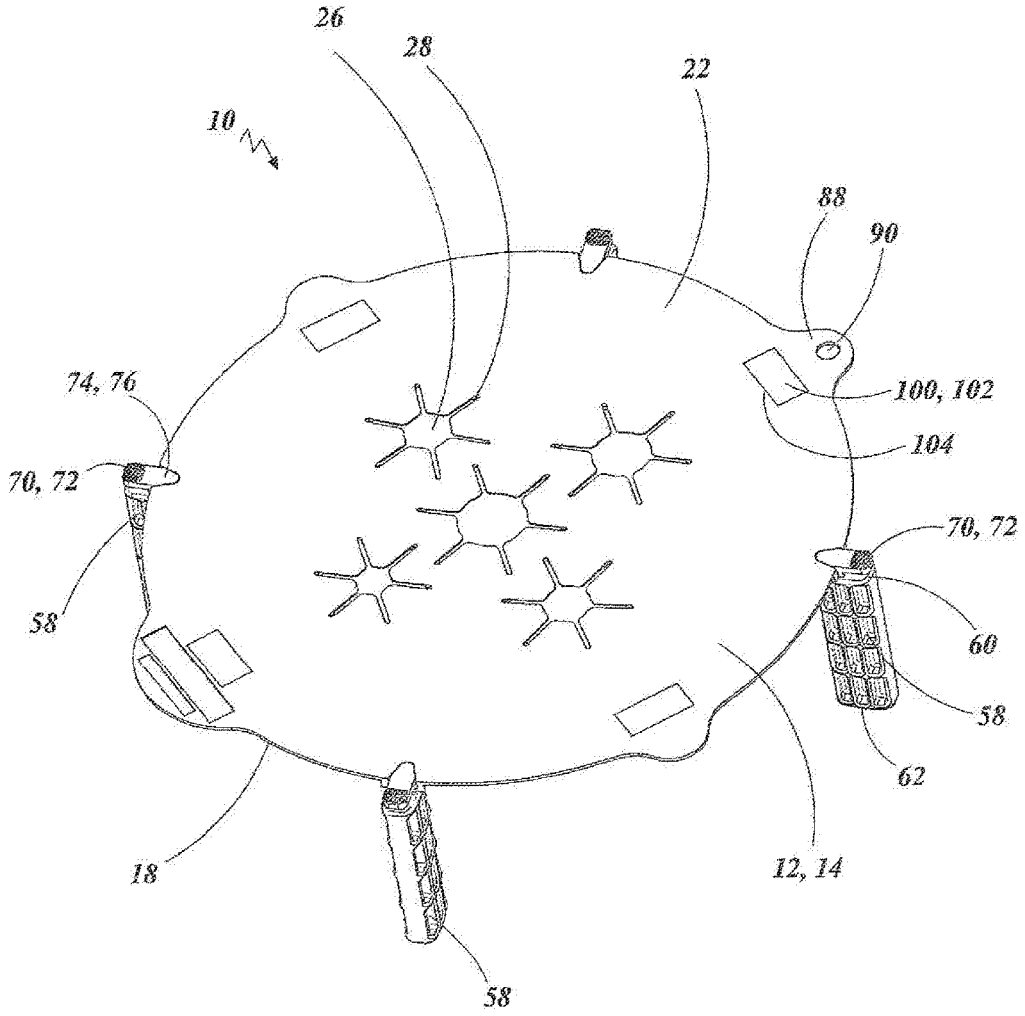
FIG. 9 is an orthographic view showing the HIDP disk with four legs attached and a solid uniform material center section.
Figure 10:
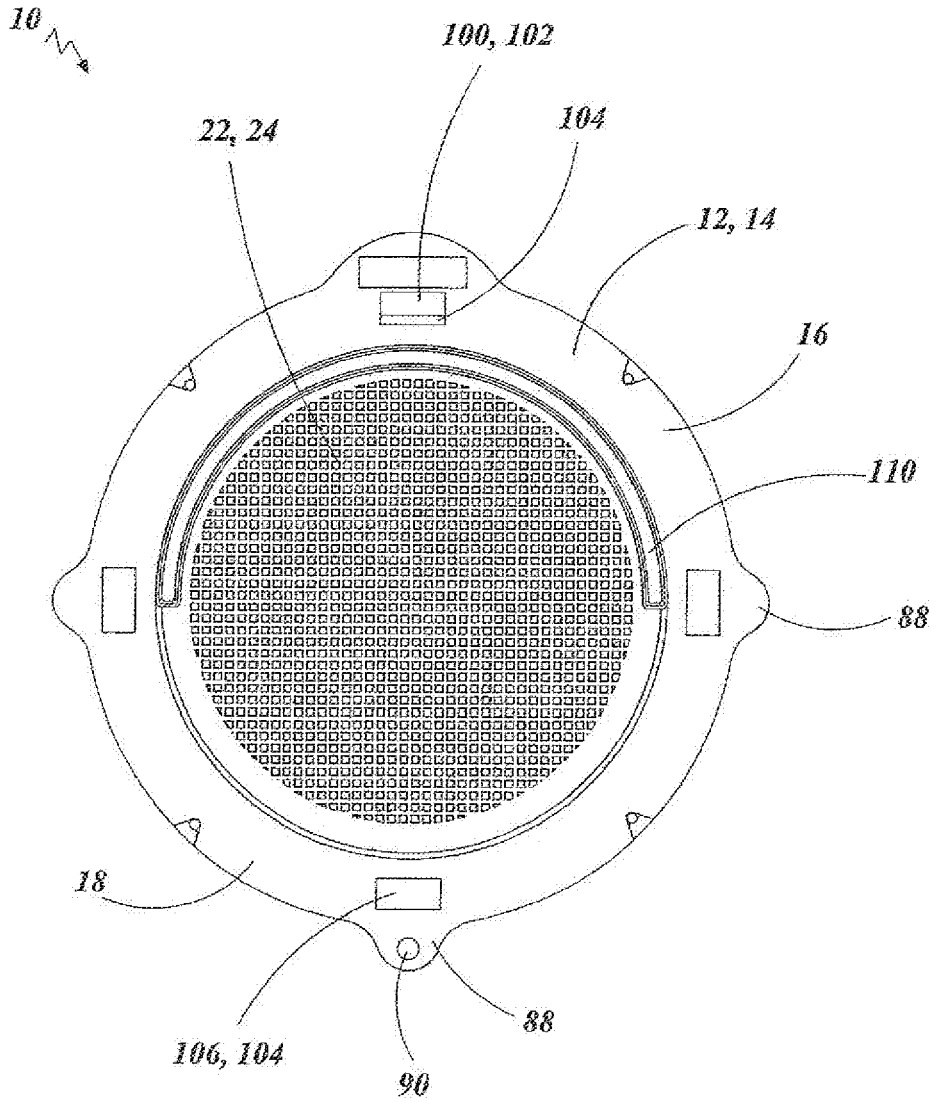
FIG. 10 is a top plan view of the HDIP with a mesh center section.
Figure 15:
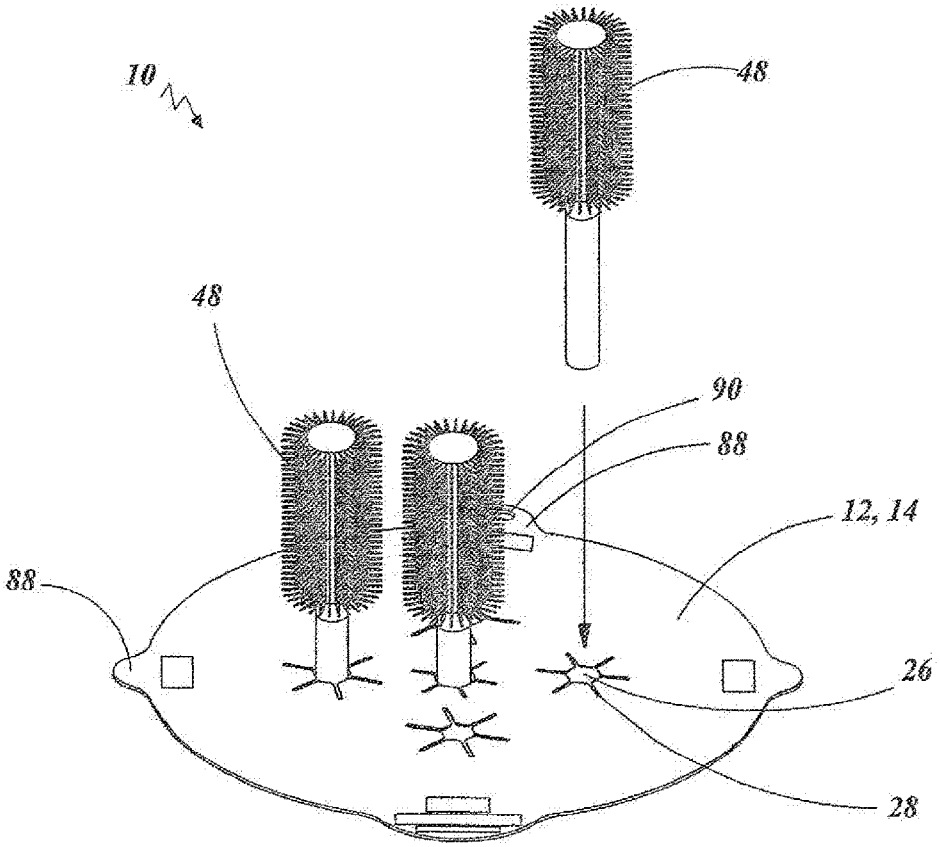
FIG. 15 is an orthographic view of the HIDP showing how multiple brushes are inserted into the openings and maintained on the disk.

In an alternate design, the HIDP 10 can be comprised of a disk with at least three downward-extending legs functioning as a free-standing HIDP 56. The free-standing HIDP 56 can either be placed on a flat surface and allow items placed through or on the disk to air dry, or the free-standing HIDP 56 can be placed on a flat surface directly beneath a blow dryer 50, as shown in FIG. 6. The legs 58 are between 6-inches and 12-inches long, and can be hingedly attached so that each leg 58 can be folded flat onto the lower surface 16 of the disk 12 for storage or when not in use. Preferably each leg 58 is comprised of an upper end and a lower end, and located on the upper end is a leg securing means 66 including a clip 68 with an outer end 70 having finger grooves 72, and an inner end 74 having a tab 76 that utilizes a spring to produce downward pressure from the tab. Located on the disk center section, adjacent the perimeter edge, is a leg securing slot 82 that is positioned and dimensioned to interface with the tab on the leg's upper end. Downward pressure is applied onto the clip's outer end, which causes the spring to raise the clip's inner end 74, at which time the clip 68 is slid inward and interfaces with the leg securing slot 82 on the center section. When the downward pressure is released the clip's inner end moves downward and the inner end tab enters the leg securing slot 82. Each leg is similarly secured to the disk, and when the legs are secured, the HIDP is placed on a substantially flat surface. As shown in FIG. 15, at least one haircare item is secured onto the disk center section and left for a period of time to air dry, or a hand held blow dryer is utilized to apply heated air onto the haircare item, or the HIDP is placed beneath an overhead blow dryer from which heated air is directed onto the haircare item.

Also, the HIDP 10 can be sold as a kit (not shown) along with dome that functions with a conventional hand-held blow dryer. The previously disclosed designs of HIDP 10 can be used with a hand-held blow dryer, but the inclusion and use of the dome provides directed heated air that provides the functionality of an over-head blow dryer with the convenience and lower cost of using a hand-held blow dryer. The kit with the dome can be used with the preferred embodiment of the HIDP 10, or with the alternate design having downward-extending legs.

Figure 11:
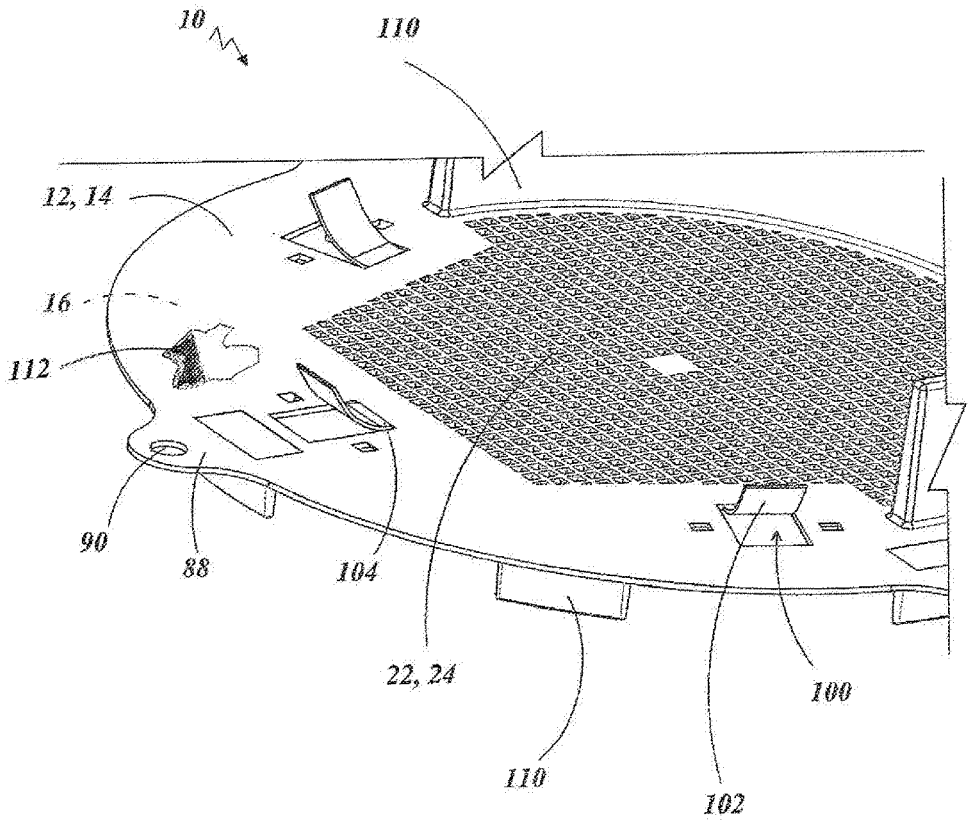
FIG. 11 is an orthographic view of the HIDP with a mesh center section and disk openings.
Figure 12:
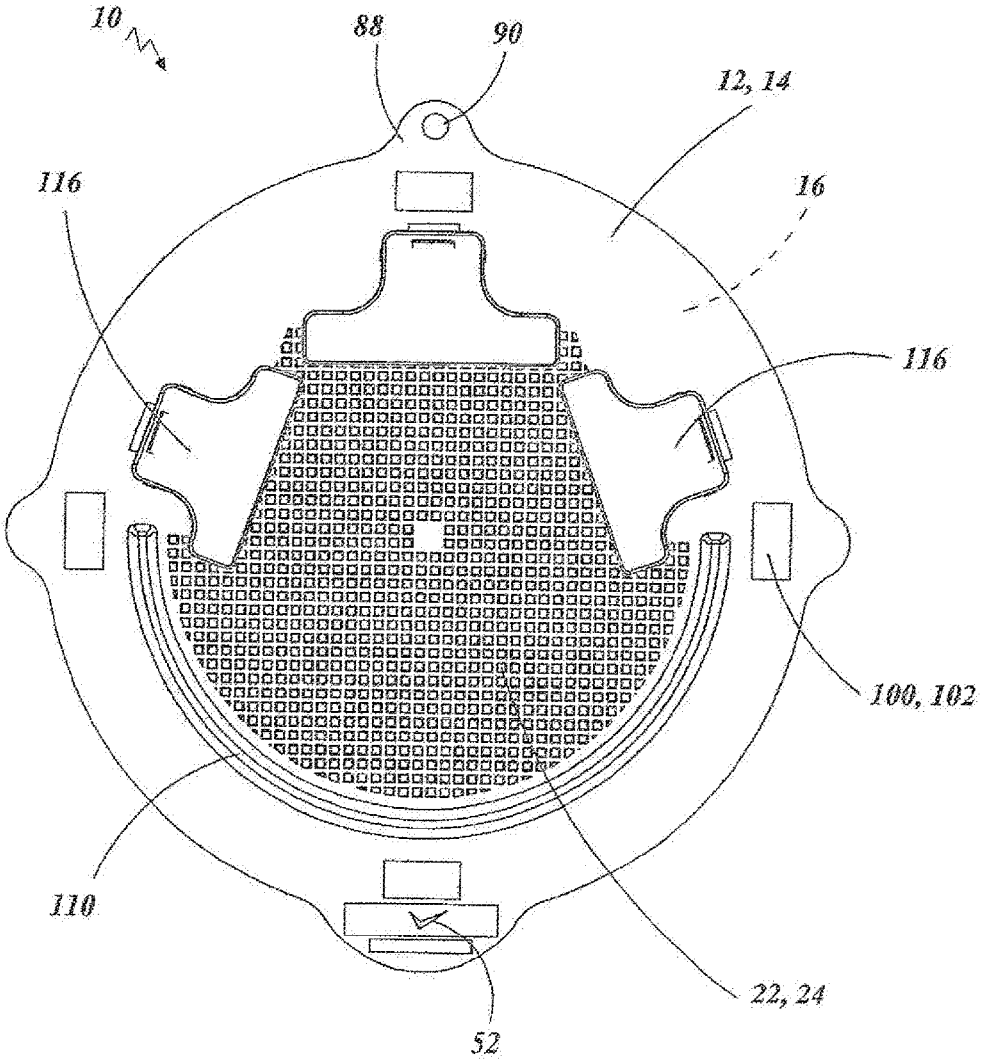
FIG. 12 is a top plan view of the HIDP with a mesh center section and three securing clips.
Figure 13:
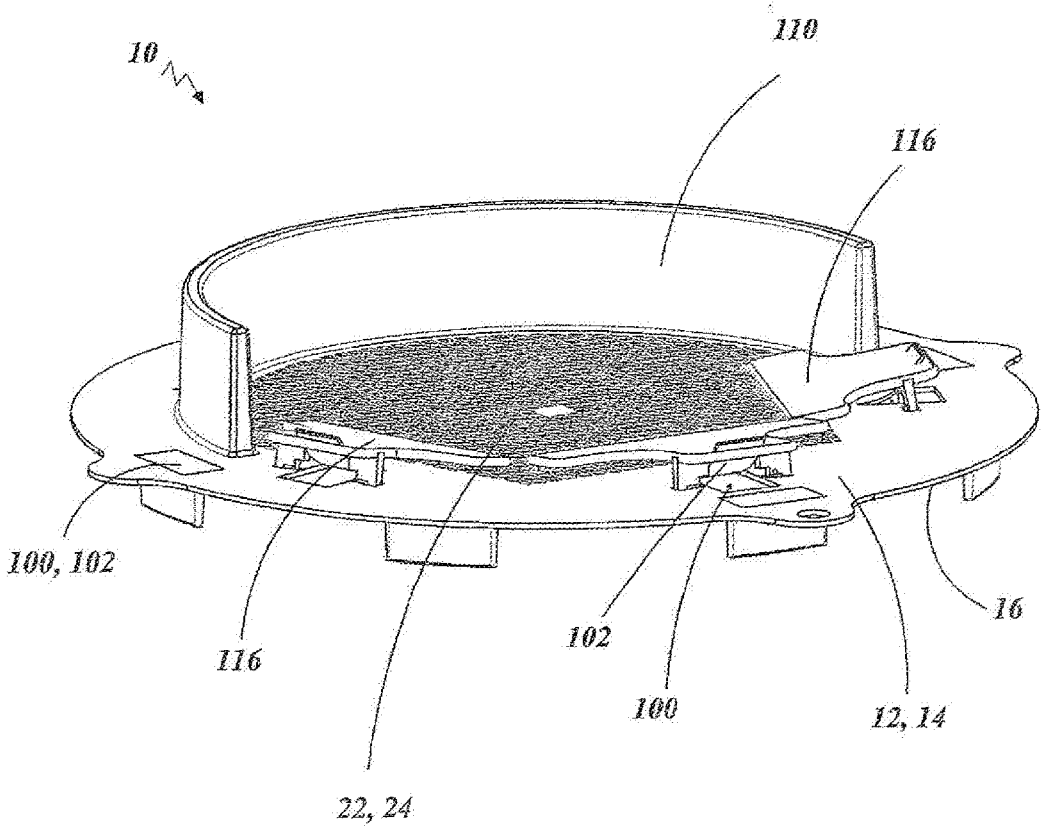
FIG. 13 is an orthographic top view of the HIDP with a mesh center section, securing clips, a semi-circular vertical member, and downward extending members.
Figure 14:
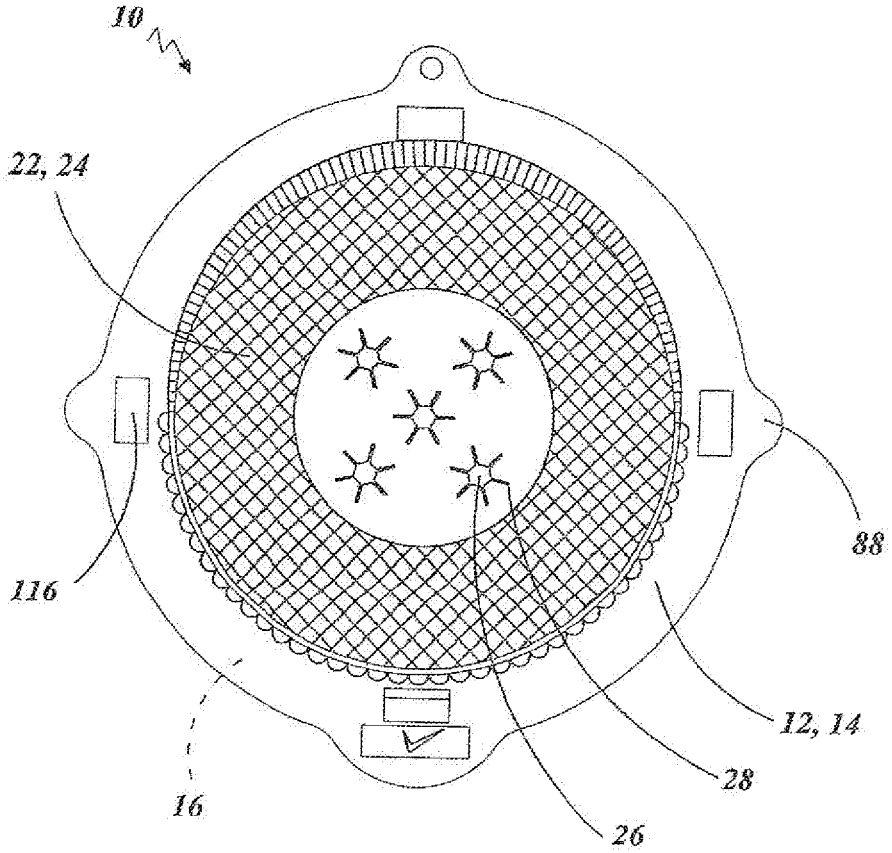
FIG. 14 is a top plan view of the HIDP with a removable and interchangeable center section.

To increase the functionality of the HIDP 10, additional features can be utilized including: at least one downward extending member 112, as shown in FIG. 11, that is locate on the lower surface 16 of the disk 12 and provides a more secure attachment of the HIDP 10 to an overhead blow dryer, and at least one securing clip 116 that is located on the upper surface 14 of the disk 12 and allows a haircare item such as human hair to be clamped down onto the disk's upper surface. Also, the center section 22 can be removable and interchangeable either with a mesh material or as a solid uniform material (as previously disclosed).

While the invention has been described in detail and pictorially shown in the accompanying drawings it is not to be limited to such details, since many changes and modification may be made to the invention without departing from the spirit and the—scope thereof. Hence, it is described to cover any and all modifications and forms which may come within the language and scope of the claims.

The invention claimed is:

1. A haircare item drying platform (HIDP) that functions in combination with an over-head blow dryer to facilitate the drying of haircare items by utilizing heated air that is produced by and emanated from the over-head blow dryer, wherein said HIDP is comprised of a disk with an upper surface, a lower surface, a perimeter edge, and a center section that is made of a mesh material and having at least one opening, wherein located on the upper surface, adjacent the perimeter edge, or on the perimeter edge are at least two attachment means for securing said disk to a head opening on the over-head blow dryer, wherein said center section having at least one opening into which a haircare item is placed, wherein said center section opening is comprised of a plurality of outward extending slits, or is comprised of a cut-out that is dimensioned to accept a haircare item, wherein at least one haircare item is placed on said center section or is inserted into the opening and captively retained within the opening with a functional component of the haircare item exposed upon an upper surface of said center section, wherein said disk is secured by attachment means onto and substantially covering head opening on the over-head blow dryer, wherein once said disk with at least one haircare item thereon is secured, the overhead blow dryer is activated, thereby blowing heated air onto said disk and haircare item, wherein after a selected period of time said disk is released from the overhead blow dryer and the haircare item is removed from said disk.

2. The haircare item drying platform as specified in claim 1 wherein said disk is made of a material selected from the group consisting of plastic, wood, cardboard or a composite material.

3. The haircare item drying platform as specified in claim 1 wherein said disk is substantially circular shaped.

4. The haircare item drying platform as specified in claim 1 wherein said center section mesh material is made of a material selected from the group consisting of plastic, fabric, or a composite material.

5. The haircare item drying platform as specified in claim 1 wherein the attachment means for securing said disk onto and substantially covering the head opening on the overhead blow dryer are selected from the group consisting of strips, string, hook and loop fastener, snap closure or clip.

6. The haircare item drying platform as specified in claim 1 further comprising at least three removable attached legs that extend downward from the perimeter of said disk and allow said HIDP to be utilized as a free-standing apparatus, wherein said leg is comprised of an upper end and a lower end, wherein located on the upper end is a leg securing means including a clip with an outer end having finger grooves, and an inner end having a tab that utilizes a spring to produce downward pressure from the tab, wherein located on said disk center section, adjacent the perimeter edge, is a leg securing slot that is positioned and dimensioned to interface with the tab on said leg's upper end, wherein downward pressure is applied onto the clip's outer end, wherein the downward pressure causes the spring to raise the clip's inner end, at which time the clip is slid inward and interfaces with the leg securing slot on said center section, wherein the downward pressure is released, thereby causing the clip's inner end to move downward and for the inner end tab to enter the leg securing slot, wherein each leg is similarly secured to said disk, wherein when said legs are secured, said HIDP is placed on a substantially flat surface, wherein at least one haircare item is secured onto said disk center section and left for a period of time to air dry, or a hand held blow dryer is utilized to apply heated air onto the haircare item, or said HIDP is placed beneath an overhead blow dryer from which heated air is directed onto the haircare item.

7. The haircare item drying platform as specified in claim 6 wherein said at least one leg is made of a material selected from the group consisting of plastic, metal, wood or a composite material.

8. The haircare item drying platform as specified in claim 1 further comprising at least one perimeter tab that extends outward from the perimeter of said center section, wherein said perimeter tab facilitates the securement and interface of said disk to a head opening on an overhead blow dryer and provides a gripping section by which said disk is held by a person's fingers.

9. The haircare item drying platform as specified in claim 8 wherein as said tab extends outward, said tab is substantially rounded.

10. The haircare item drying platform as specified in claim 1 further comprising at least one disk opening that is located on said center section adjacent the perimeter, wherein said disk opening has a cover that is lifted upward or pushed downward, thereby creating an opening through said center section.

11. The haircare item drying platform as specified in claim 1 wherein said disk opening cover is lifted upward or pushed downward by means of a living hinge located on one side edge of said cover.

12. The haircare item drying platform as specified in claim 1 further comprising a semi-circular vertical member that extends upward from said center section's upper surface, along substantially one-half of said center section's perimeter thereby encompassing one-half of said center section, wherein said vertical member interfaces with an inner surface of the head opening on the overhead blow dryer, to maintain the position of said disk when secured to the overhead blow dryer, and said vertical member provides a barrier that maintains a haircare item when the haircare item is placed on said center section.

13. The haircare item drying platform as specified in claim 1 further comprising at least one securing clip that is hingedly attached facing inward to the upper section of said center section, adjacent said center section's perimeter edge, wherein when downward pressure is applied to an end of said clip, an opposite end is raised, wherein a haircare item is inserted within the raised end, wherein the downward pressure is released thereby forcing said cli end downward onto the haircare item, thereby maintaining the haircare item on said center section.

14. The haircare item drying platform as specified in claim 1 further comprising at least one downward extending member located on the lower surface of said disk, wherein said downward extending member provides a secure attachment of said HIDP to an overhead blow dryer.

15. The haircare item drying platform as specified in claim 1 further comprising at least one securing clip that is located on the upper surface, adjacent the perimeter edge of said disk, wherein said clip maintains a haircare item securely in place on the upper surface of said disk.

16. The haircare item drying platform as specified in claim 1 further comprising at least one attachment interface located on the upper surface, adjacent the perimeter edge of said disk, wherein said interface having a hook and loop fastener attached thereon, wherein a corresponding hook and loop fastener is located on an edge of the overhead blow dryer, thereby allowing the two hook and loop fasteners to attach together, which secures said HIDP to the overhead blow dryer.

17. The haircare item drying platform as specified in claim 1 further comprising a removable and interchangeable center section, wherein said removable and interchangeable center section having a mesh material or a solid uniform material that can be switched for multiple uses or applications.

* * * * *